US005494279A

United States Patent [19]

Ahner

[11] Patent Number: 5,494,279

[45] Date of Patent: Feb. 27, 1996

[54] GOLF BALL TEE SETTING DEVICE

[76] Inventor: Roger W. Ahner, 1502 Kauffman Rd., Pottstown, Pa. 19464

[21] Appl. No.: 241,558

[22] Filed: May 12, 1994

[51] Int. Cl.[6] ..... A63B 57/00

[52] U.S. Cl. ..... 273/32.5

[58] Field of Search ..... 273/32.5

[56] References Cited

U.S. PATENT DOCUMENTS

| | | | |
|---|---|---|---|
| 1,863,140 | 6/1932 | Mulvaney | 273/32.5 |
| 4,142,719 | 3/1979 | Blood | 273/33 |
| 4,714,250 | 12/1987 | Henthorn | 273/32.5 |
| 4,819,938 | 5/1989 | Hill | 273/32.5 |
| 4,949,961 | 8/1990 | Milano | 273/32.5 |
| 4,951,947 | 8/1990 | Kopfle | 273/32.5 |
| 4,969,646 | 11/1990 | Tobias | 273/32.5 |
| 4,989,868 | 2/1991 | Manko | 273/33 |
| 5,165,744 | 11/1992 | Vogrin | 294/19.2 |
| 5,171,010 | 12/1992 | Lanoue | 273/32.5 |

*Primary Examiner*—George J. Marlo

*Attorney, Agent, or Firm*—Eric A. LaMorte

[57] ABSTRACT

A tee setting device and the associated method for setting a golf tee into the ground. The device includes a tubular shaft having a head assembly at one end and a handle assembly at the opposite end. The head assembly includes a mechanism for retaining a golf tee and orienting the golf tee at a perpendicular to the ground. A pushrod is disposed within the shaft between the handle assembly and the head assembly. A selectively adjustable engagement device is present within the handle assembly. The engagement device enables a handle to engage the pushrod at different points. The handle is movable through a predetermined range relative the shaft. Accordingly, by selectively coupling the handle to the pushrod at different points, the handle can be used to move the pushrod a given distance within the shaft. The end of the pushrod, opposite the handle, is disposed above the golf tee that is retained in the head assembly. As the handle drives the tee within the shaft, the pushrod abuts against the golf tee and drives the tee into the ground. The point at which the handle engages the pushrod determines at what height the tee is left above the ground.

19 Claims, 10 Drawing Sheets

GOLF BALL TEE SETTING DEVICE

BACKGROUND OF THE INVENTION

1. Field of the Invention

The present invention relates to devices that enable a golfer to set a golf ball tee into the ground without having to bend over to ground level. More particularly, the present invention relates to a golf tee setting device that automatically sets the tee to a desired height, wherein the desired height can be selectively adjusted to match the requirements of the golfer.

2. Prior Art Statement

As is well known in the game of golf, on the first shot of each hole the golfer is allowed to set the golf ball upon a tee. Tees are manufactured in a large variety of shapes, sizes and materials. However, the most common tee is the simple wooden tee that has an enlarged head to support a golf ball and a tapered body that can be driven into the earth. The typical golfer drives a tee into the ground by holding a golf ball over the tee in one hand. The golfer then bends over to ground level and drives the tee into the ground by applying a downward force to the golf ball. Such a typical method of setting a tee works well for many golfers but does embody certain disadvantages. First, golf is a game of both precision and consistency. Golfers practice for years in an attempt to perfect their golf swing. However, if the golf ball is not set consistently at the same tee height, that practiced swing must constantly be altered to properly meet the ball. This need for readjustment creates inconsistencies in the tee shots of golfers that detract from their overall performance.

Another disadvantage of manually setting a tee into the ground is that the ground conditions vary widely from week to week. Some days the ground is wet and soft. As a result, the tee must often be set deeply into the ground in order to support the golf ball. On other days, the ground is dry and very hard. During such conditions, it is very difficult to manually drive the tee into the ground. As a result, the tee is often broken as it is driven into the ground or the tee is left at a high position because the tee can only be partially driven into the ground.

Yet another disadvantage of manually setting a tee is that many people are just physically incapable of comfortably moving their bodies into the position needed to set a tee. Golf is a very popular sport with senior citizens. Many senior citizens cannot comfortably bend over to ground level. Accordingly, it is difficult for these individuals to properly set a tee.

The prior art is replete with devices that help a golfer set a tee. However, few eliminate all of the disadvantages previously mentioned. For instance, U.S. Pat. No. 5,171,010 to Lanome, entitled GOLF BALL TEEING APPARATUS describes a device for setting a tee into the ground. This device makes it easier to set the tee into hard ground and eliminates the need to bend to ground level. However, there is no mechanism that ensures that the tee is set at a desired height each time the tee setter is used. As such, the tee setter inconsistently sets the depth of the tee resulting in inconsistent tee shots, as was previously explained.

U.S. Pat. No. 4,142,719 to Blood, entitled GOLF TEE INSERTION DEVICE shows a tee setting device that does set a tee at the same height each time it is used. However, to adjust the height at which the tee is set, the bottom of the tee setter must be rotated relative the shaft. This requires the golfer to engage the often wet and/or dirty ground end of the tee setter and provide a twisting motion. Many golfers who are incapable of manually setting their tees into the ground have arthritis. This ailment also prevents these golfers from providing the strong twisting motion needed to adjust a tee setting device as disclosed in the Blood patent. Additionally, the Blood tee setting device only sets the tee. The golfer must then bend over to ground level to place the ball on the tee, which is just as burdensome a task as setting the tee to many golfers.

The prior art also fails to show a tee setting device that is capable of boring a hole into the ground prior to the setting of a tee. By providing a device capable of boring a hole, tees could be much more easily set into hard and/or dry ground.

In view of the disadvantages embodied by prior art tee setting devices, it is an object of the present invention to provide a tee setting device that is easy to adjust, sets the tee at a desired height, and sets the ball upon the tee.

It is a further object of the present invention to provide such a tee setter that is easy to use, light weight and inexpensive.

It is still another object of the present invention to provide a tee setter that is capable of boring a hole into the ground prior to the setting of the tee.

SUMMARY

The present invention is a device and the associated method for setting a golf tee into the ground. The device includes a tubular shaft having a head assembly at one end and a handle assembly at the opposite end. The head assembly includes a mechanism for retaining a golf tee and orienting the golf tee at a perpendicular to the ground. A pushrod is disposed within the shaft between the handle assembly and the head assembly. A selectively adjustable engagement device is present within the handle assembly. The engagement device enables a handle to engage the pushrod at different points. The handle is movable through a predetermined range relative the shaft. Accordingly, by selectively coupling the handle to the pushrod at different points, the handle can be used to move the pushrod a given distance within the shaft.

The end of the pushrod, opposite the handle, is disposed above the golf tee that is retained in the head assembly. As the handle drives the tee within the shaft, the pushrod abuts against the golf tee and drives the tee into the ground. The point at which the handle engages the pushrod determines at what height the tee is left above the ground. The handle can also selectively engage the pushrod in such a manner that the handle can drive the pushrod through the head assembly and into the ground below the head assembly. The pushrod therefore creates a pilot hole in the ground that enables the tee to be more easily set without concern of the tee breaking.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
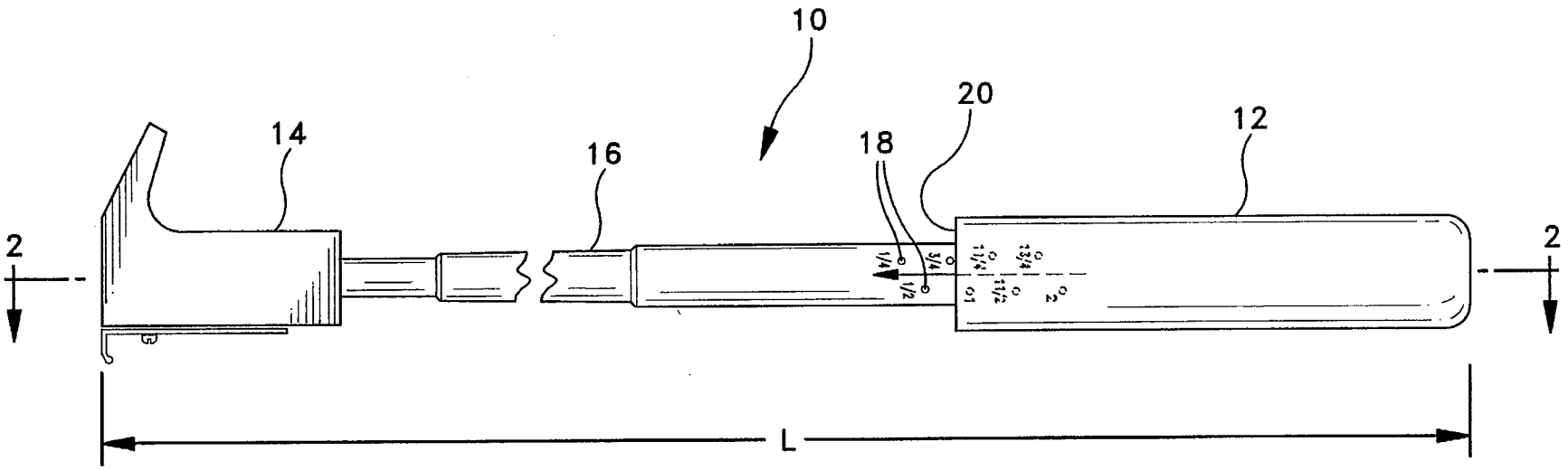
FIG. 1 is a side view of one preferred embodiment of the present invention.

Referring to FIG. 1, there is shown one preferred embodiment of the present invention golf tee setting device 10. The device 10 has a length L that is between 28 inches and 38 inches long so that the tee setting device 10 has the same general length L as a typical golf club. The tee setting device 10 has a handle assembly 12, a head assembly 14 and a tapered shaft 16 that joins the head assembly 14 to the handle assembly 12. As a result, the tee setting device 10 has the same overall appearance as a golf club and can be carried in any device or bag designed to carry golf clubs.

The mechanism that governs how deep a tee is to be set is contained within the handle assembly 12. Indicia 18 in the form of a depth gauge is disposed on the shaft 16 proximate the handle assembly 12. The bottom surface 20 of the handle assembly 12 acts as a depth gauge marker providing an easily viewed indication as to what tee height the tee setting device 10 will set a tee. In the shown embodiment, the indicia 18 is printed in inches ranging from ¼ inch to 2 inches, wherein the tee setting device is set at the ¾ inch mark. The ¾ inch setting can be ascertained by a person looking at the bottom surface 20 of the handle assembly 12 aligning with the ¾ inch indicia on the shaft 16. The adjustment scale used is merely exemplary and any other practical range may be used. Similarly, the indicia 18 need not be numbers but can be graphic symbols, color codes or any other distinguishing scale.

Figure 2:
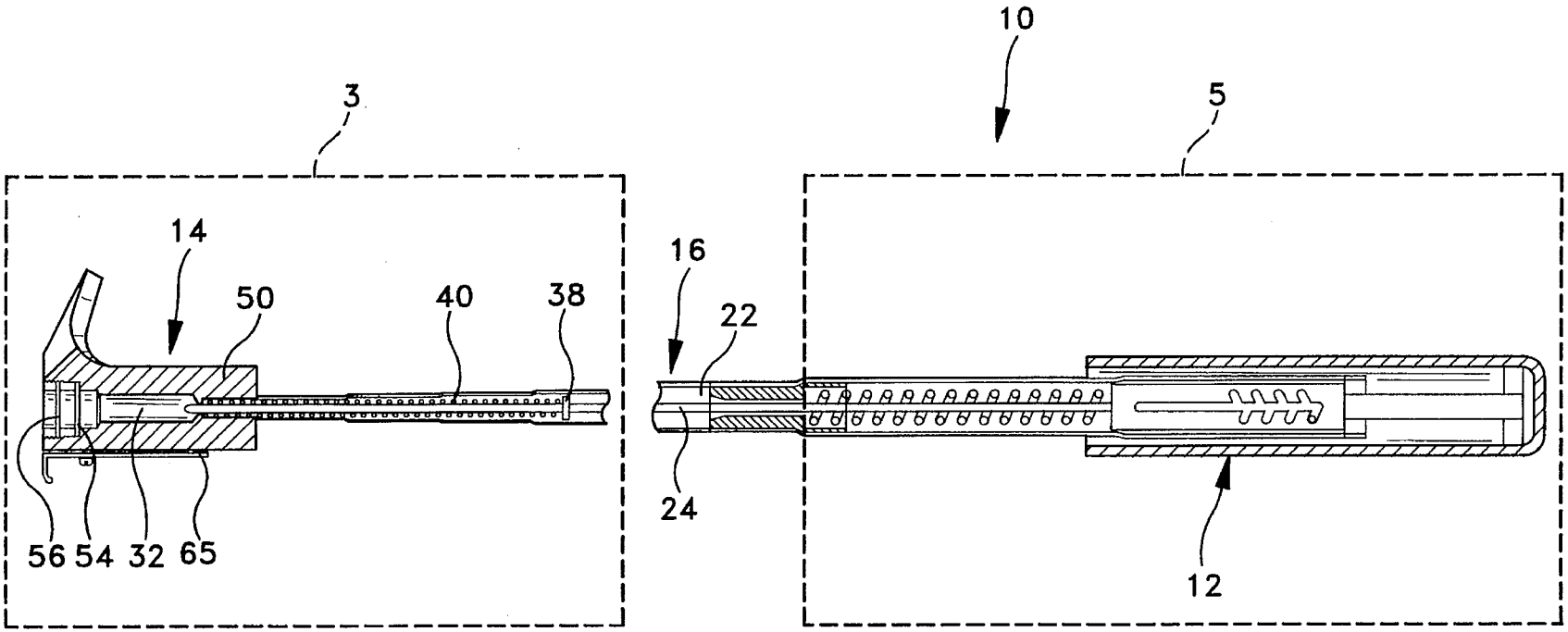
FIG. 2 is a selectively cross-sectioned view of the embodiment shown in FIG. 1 viewed along section line 2—2.

Referring to FIG. 2, a cross-sectional view of the present invention tee setting device 10 is shown. As can be seen, the tapered shaft 16 that extends between the handle assembly 12 and the head assembly 14 is hollow defining a central cavity 22. A pushrod 24 travels through the center of the central cavity 22 within the shaft 16. The pushrod 24 is not affixed to the shaft 16. As a result, the pushrod 24 can move reciprocally back and forth along the longitudinal axis of the shaft 16.

Figure 3:
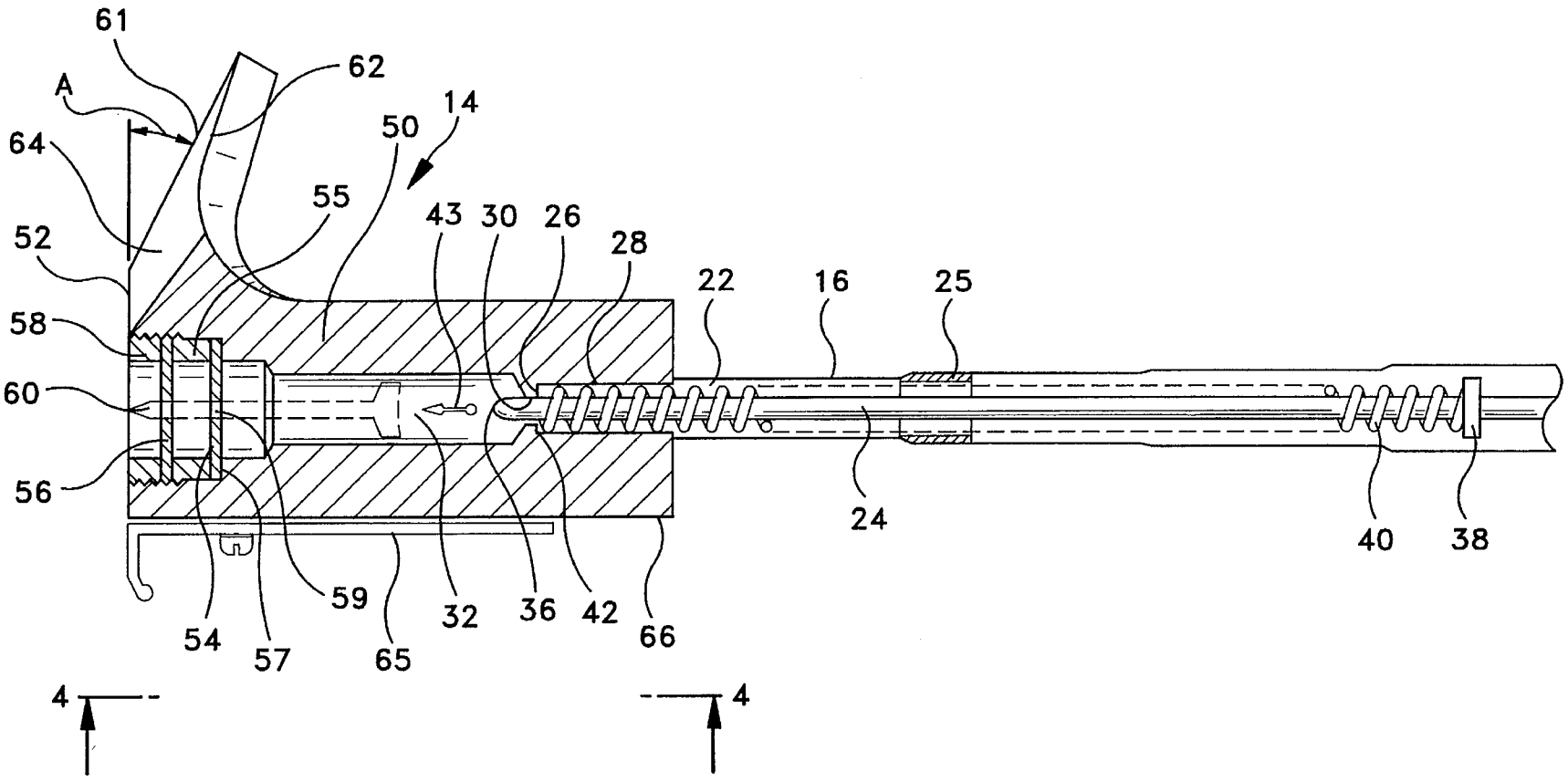
FIG. 3 is an enlarged view of the portion of FIG. 2 contained within region 3.

Referring to FIG. 3 in conjunction with FIG. 2, it can be seen that the main body of the head assembly 14 has a cavity 28 formed within it that faces the handle assembly 12. The narrow end 26 of the tapered shaft 16 terminates with the cavity 28, thereby joining the shaft 16 to the head assembly 14. The shaft 16 may screw into the head assembly 14, be adhesively bonded to the head assembly 14 or be press fit into place. A small aperture 30 is located at the bottom of the cavity 28 in the head assembly 14. The small aperture 30 communicates with the central cavity 22 defined by the shaft 16. The small aperture 30 thereby connects the central cavity 22 defined by the shaft 16 to the tee engagement chamber 32, the purpose of which will be later described.

The pushrod 24 extends through the central cavity 22 defined by the shaft 16. As such, the pushrod 24 extends into the cavity 28 in the head assembly 14, through the small aperture 30 and into the tee engagement chamber 32. In the shown embodiment, the end 36 of the pushrod 24 is slightly pointed and extends partially into the tee engagement chamber 32 when the setting device 10 is at rest. The pointed end 36 of the pushrod 24 serves a purpose which will later be described.

A spring stop 38 is attached to the pushrod 24 at a position well within the central cavity 22 of the shaft 16. The spring stop 38 can be any structure that prevents secondary return spring 40 from passing a predetermined point on the pushrod 24. The secondary return spring 40 extends between the surface 42 in the head assembly 14, that defines the small aperture 30, and the spring stop 38. The secondary return spring 40 is sized to be too large to pass through the small aperture 30 and too small to pass around the spring stop 38. As such, when the pushrod 24 is advanced in the direction of arrow 43, the secondary return spring 40 acts to return the pushrod 24 to its at rest position as illustrated in FIG. 2. A travel stop 25 is positioned within the shaft 16 as illustrated in FIG. 3. The secondary return spring extends through the center of the travel stop 25. When the pushrod 24 is advanced in the direction of arrow 43, the spring stop 38 eventually abuts against the travel stop 25. The contact between the spring stop 38 and the travel stop 25 prevents the pushrod 24 from being hyperextended. Accordingly, the secondary return spring 40 is prevented from being over compressed and damaged.

The head assembly 14 is comprised primarily of a generally J-shaped element 50 that defines the cavity 28, small aperture 30 and tee engagement chamber 32. In a preferred embodiment, the J-shaped element 50 is made of plastic because of its light weight and corrosion resistance. However, any other material, such as metals or ceramics can also be used. The tee engagement chamber 32 extends from the small aperture 30 to the bottom surface 52 of the J-shaped element 50. Two elastomeric annular members 54, 56 are disposed in the tee engagement chamber 32 proximate the bottom surface 52 of the J-shaped element 50. The first elastomeric annular member 54 is held in place by an annular spacer 55 that compresses the first elastomeric annular member 54 against a ridge 57 within the tee engagement chamber 32. The second elastomeric annular member 56 abuts against the annular spacer 55 and is held in place by an externally threaded member 58 that screws into the tee engagement chamber 32. Both of the elastomeric annular members 54, 56 define central apertures 59, 60. These apertures 59, 60 easily stretch open to allow the head of a tee to be passed into the tee engagement chamber 32. However, the apertures 59, 60 return to a diameter that is small enough to firmly engage the shaft of a tee after the head of the tee has been passed through. In an alternate embodiment, the two elastomeric annular members 54, 56 could be replaced with flexible bristles, spring elements or any other flexible gripping element capable of retaining a golf tee.

The foot region 61 of the J-shaped element 50 defines a depression 62 that is shaped to hold and retain a golf ball. A slot 64 is disposed in the depression 62 thereby providing the foot region with a hammer claw configuration. The primary function of the slot 64 is to guide a supported golf ball onto a tee, as will later be explained. The foot region 61 extends at an angle A from the plane of the bottom surface 52. Angle A is any angle that enables the foot region 61 to hold and retain a golf ball when the shaft 16 is held generally at a vertical orientation.

Figure 4A:
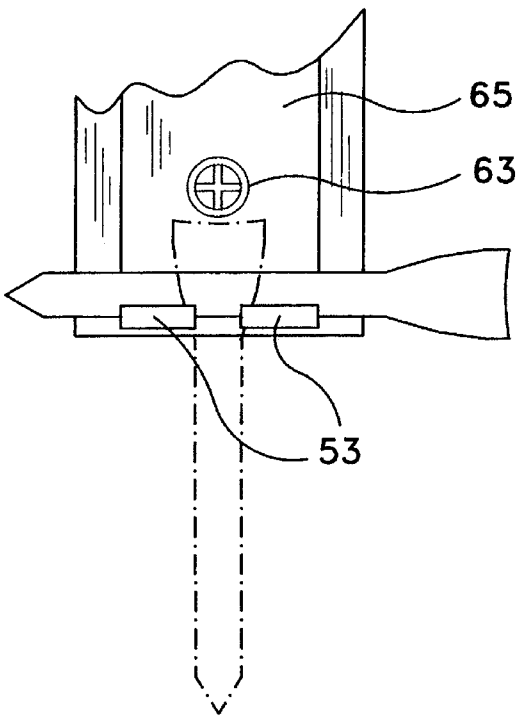
FIG. 4*a* is a fragmented view of the head region shown in FIG. 4, shown in conjunction with a tee to facilitate consideration and discussion.
Figure 4:
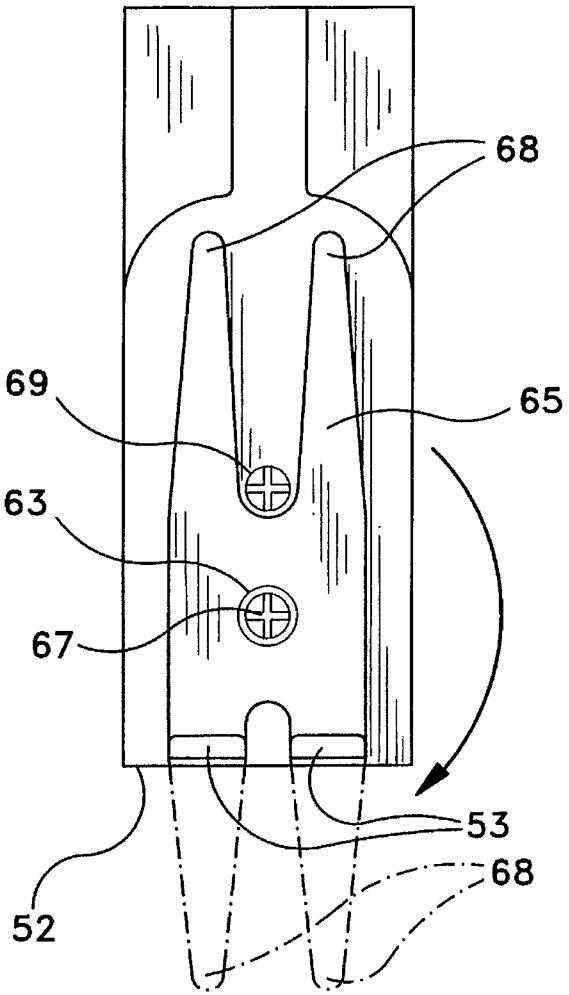
FIG. 4 is a rear view of the head region of the present invention shown in FIG. 3, viewed along perspective line 4—4.

A divot repair member 65 is pivotably coupled to a surface 66 of the J-shaped element 50 opposite the foot region 61. Referring to FIG. 4, it can be seen that the divot repair member 65 can be rotated about pivot member 67, whereby the divot tongs 68 would extend below the bottom surface 52 of the J-shaped element 50. A stopper 69 is also disposed on the J-shaped element 50, The stopper 69 resists the rotation of the divot repair member 65, thereby preventing the unintentional rotation of the divot repair member 65 when not in use. In FIG. 4*a* it can be seen that projections 53 extend from one end of the divot repair member 65. The projections enable the divot repair member 65 to pull tees from the ground or lift a tee that is lying on the ground. A spring washer 63 is disposed between the divot repair member 65 and the pivot member 67. The spring washer 63 biases the divot repair member 65 against the J-shaped element 50 and provides enough flexibility in the movement of the divot repair member 65 to enable the divot repair member 65 to pass over the stopper 69.

Figure 5:
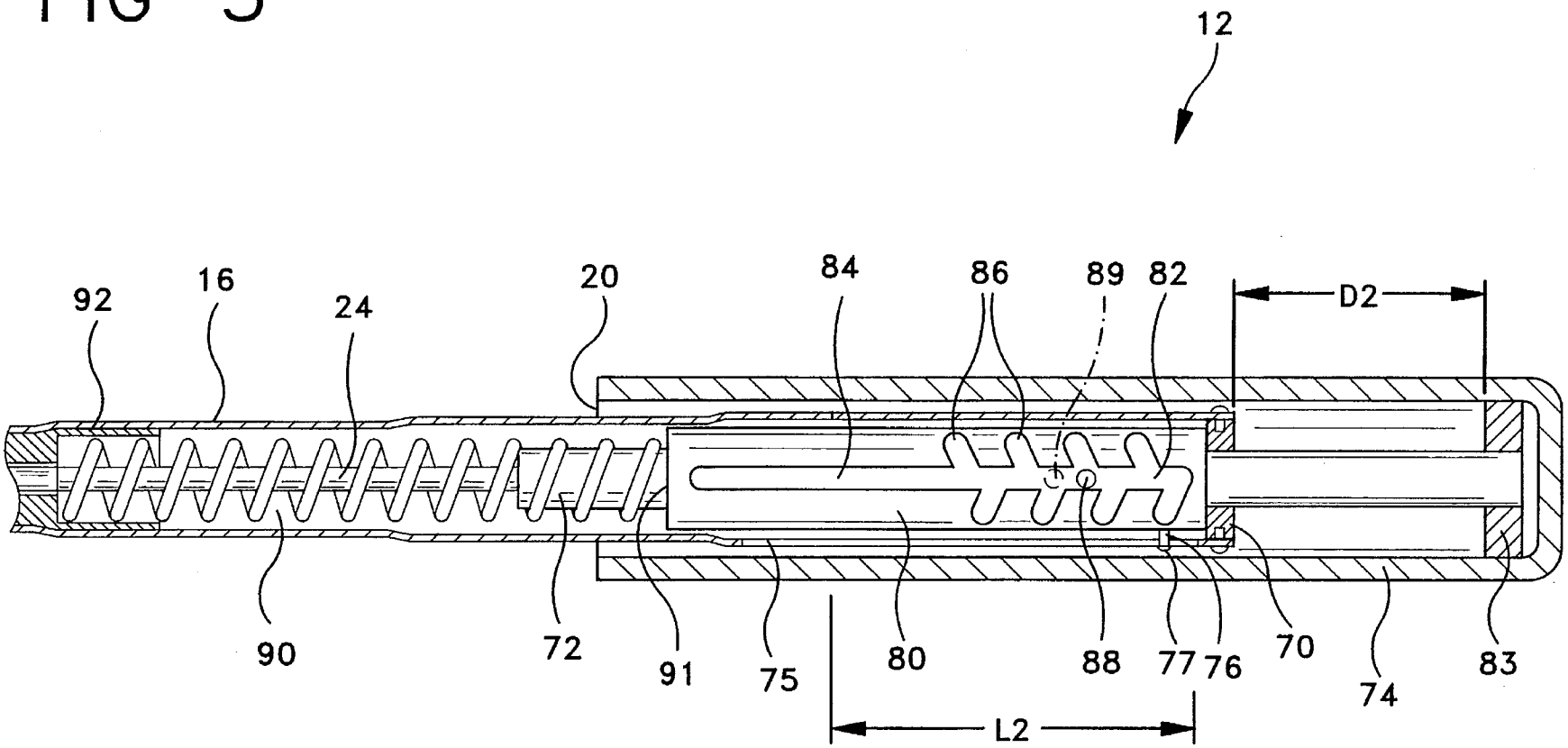
FIG. 5 is an enlarged view of the portion of FIG. 2 contained within region 5.

Referring to FIG. 5 in conjunction with FIG. 2, the handle assembly 12 of the present invention setting device is shown. The shaft 16 extends into the handle assembly 12 and terminates at a slide bearing 70. The pushrod 24 extends into the handle assembly 12 and abuts against a control rod 72, whereby a reciprocal movement of the control rod 72 would cause a corresponding movement in the pushrod 24. The slide bearing 70, joined to the shaft 16, fits around the control rod 72. The slide bearing 70 is free to move back and forth along the length of the control rod 72. As a result, the control rod 72, and thus the pushrod 24, can be moved reciprocally with respect to the shaft 16. The control rod 72 extends through slide bearing 70 and is firmly coupled to a handle 74. The shaft 16 passes into the open bottom end 20 of the handle 74. The shaft 16 never engages the handle 74. Consequently, the shaft 16 can move reciprocally in and out of the handle 74 as the slide bearing 70 rides along the surface of the control rod 72.

A guide tube 80 is disposed around the control rod 72. The guide tube 80 is not directly attached to the control rod 72, as such the guide tube 80 may move reciprocally along the length of the control rod 72. A slot 75 having a length L2 is formed through the shaft 16 proximate the slide bearing 70. The slot 75 travels in the same direction as the longitudinal axis of the shaft 16. A key element 76 extends from the guide tube 80. The key element 76 extends through the slot 75 and terminates with an enlarged head 77 that is too large to pass through the slot 75. As the guide tube 80 moves back and forth along the control rod 72, the key element 76 slides back and forth within the slot 75. Accordingly the presence of the key element 76 in the slot 75 limits the distance the guide tube 80 can reciprocally move along the control rod 72. Additionally, the presence of the key element 76 in the slot 75 prevents the guide tube 80 from rotating with respect to the control rod 72. Consequently, the guide tube 80 and control rod 72 are maintained in the same rotational relationship.

A slotted structure 82 is formed in the guide tube 80 consisting of a primary slot 84 and branch slots 86 that extend off either side of the primary slot 84. In the shown embodiment, four branch slots 86 are shown on either side of the primary slot 84. It will be understood that this configuration is merely exemplary and any number of branch slots may be used on either one or both sides of the primary slot 84.

A set pin 88 extends from the control rod 72. The set pin 88 extends into the slotted structure 82 formed in the guide tube 80. As such, it will be understood that by moving the control rod 72 in relation to the guide tube 80, the set pin 88 can be moved along the primary slot 84 and turned into any one of the branch slots 86, thereby creating a mechanical engagement between the guide tube 80 and the centrally positioned control rod 72. An optional locking pawl 89 may be disposed on the control rod 72 proximate the set pin 88. The locking pawl 89 may engage a slot (not shown) formed in the guide tube 80. The locking pawl 89 helps maintain the set pin 88 in the primary slot 84 until the set pin 88 is turned into a branch slot 86. This helps prevent the set pin 88 from passing into the wrong branch slot 86 during operation.

A primary return spring 90 abuts against the bottom end 91 of the guide tube 80. The lower portion of the primary return spring 90 rests within a spring block 92 that is firmly anchored to the shaft 16. The primary return spring 90 therefore acts to bias the guide tube 80 in a direction away from the open bottom end 20 of the handle 74. The primary return spring 90 does not engage either the pushrod 24 or the control rod 72. Accordingly, the primary return spring 90 biases the guide tube 80 against the slide bearing 70. In the shown embodiment, the set pin 88 is not engaged to any of the branch slots 86. However, it should be understood that by rotating the handle 74 in relation to the shaft 16, the set pin 88 can be positioned into any of the branch slots 86 present on the guide tube 80. Depending upon in which of the branch slots 86 the set pin 88 is placed, the distance D2 between the slide bearing 70 and the handle anchor member 83 varies. The closer to the slide bearing 70 the set pin 88 is set, the greater the distance D2 becomes when the apparatus is not in use.

OPERATION

Figure 6:
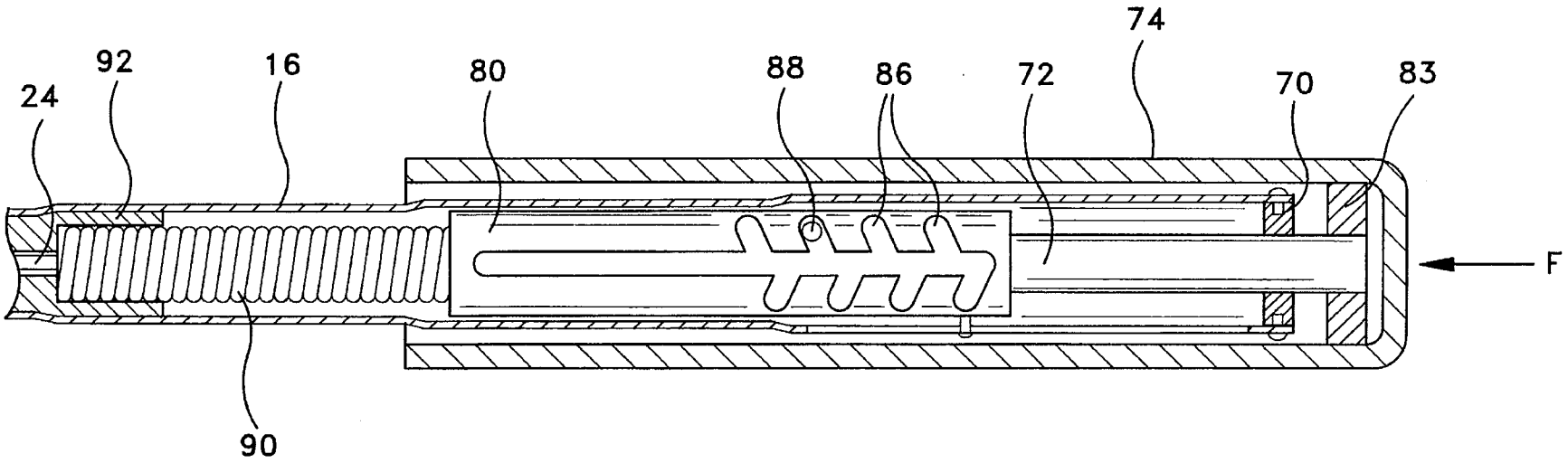
FIG. 6 shows the portion of the present invention previously shown in FIG. 5 as the invention is in use to facilitate further consideration and discussion.

The height at which the present invention setting device 10 will set a golf tee is determined by which of the branch slots 86 the set pin 88 engages. In the shown embodiment of FIG. 5, the set pin 88 is positioned proximate one of the central branch slots 86. As is seen by FIG. 6, when the set pin 88 is turned into this central branch slot, the guide tube 80 is joined to the control rod 72. When locked into this position, the bottom end 20 of the handle 74 aligns with the "¾ inch" marking on the distance gauge indicia 18 (see FIG. 1). This enables a golfer to see that the device 10 is ready to set a tee into the ground at a ¾ inch height. The distance gauge indicia 18 on the exterior of the shaft 16 (FIG. 1) correspond to the different branch slots 86 on the guide tube 80 (FIG. 5). Referring to FIG. 5, it will therefore be understood that by moving the set pin 88 into the different slots 86, a change in position occurs in between the handle 74 and the shaft 16. This causes the bottom end 20 of the handle 74 to align with the different distance gauge indicia 18 (FIG. 1) and provides the means for selectively adjusting the overall tee setting device 10.

As the set pin 88 engages the different branch slots 86 in the guide tube 80, the relative position between the handle 74 and the shaft 16 changes. Accordingly, the distance D2 between the slide bearing 70 and the handle anchor member 83 also changes. Referring now to FIG. 6, it can be seen that once the set pin 88 is engaged within one of the branch slots 86 and a force F is applied to the handle 74, the handle 74 moves in the direction of force F. The movement of the handle 74 causes the control rod 72 to move into the shaft 16. The movement of the control rod 72 therein drives the pushrod 24 through the shaft 16. Since the guide tube 80 is temporarily joined to the control rod 24 by the presence of the set pin 88 in the branch slot 86, the guide tube 80 moves with the control rod 24 relative the shaft 16. As can be seen, the movement of the handle 74 and control rod 72 in direction of force F drives the guide tube 80 away from the slide bearing 70, thereby compressing primary return spring 90. The guide tube 80 continues to compress the primary return spring 90 until the primary return spring 90 reaches its point of maximum compression. At this point, the advancement of the handle 74 is stopped by the interference caused by the primary return spring 90 as it abuts against the spring stop 92. As will be later explained, the distance the control rod 72 pushes the pushrod 24 determines how far the pushrod 24 pushes the tee and sets the tee into the ground.

Figure 7A:
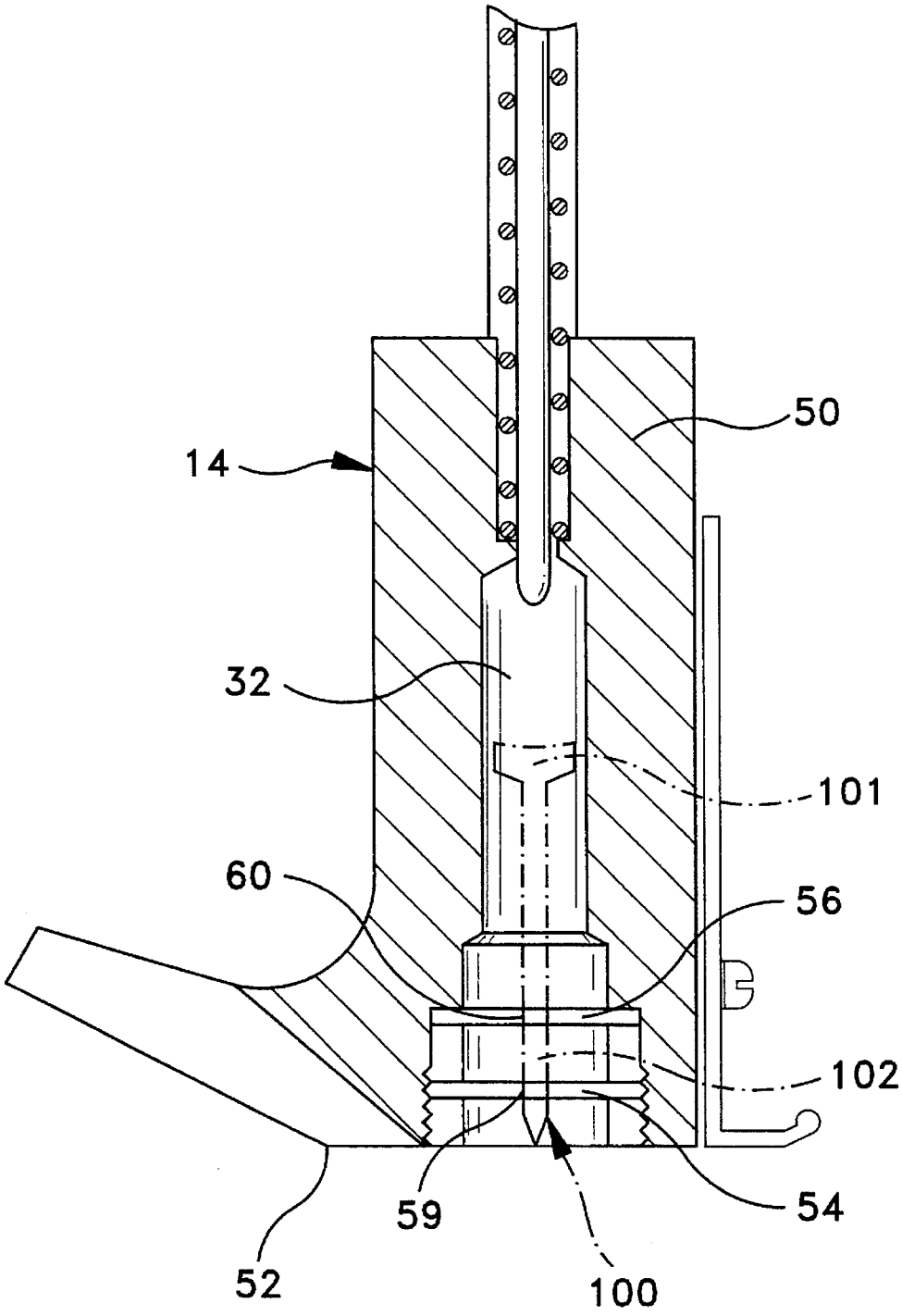
FIG. 7*a* shows a cross-section of the head region of the present invention, prior to use.

Referring to FIG. 7*a*, the head assembly 14 of the present invention is shown at rest. A tee 100 is set into the tee engagement chamber 32 through the opening on the bottom surface 52 of the J-shaped element 50. The head 101 of the tee is passed through the central aperture 59 of the first annular member 54 and the central aperture 60 of the second annular member 56. The elastomeric material of the first and second annular members 54, 56 allow for the easy passage of the head 101 therethrough. However, the elasticity of the first and second annular members 54, 56 cause them to engage the shaft 102 of the tee 100 and thereby hold the tee 100 into place in a generally vertical orientation. The diameter of the tee engagement chamber 32 is only slightly larger than the head 101 of the tee 100. This prevents the tee 100 from tilting sideways within the tee engagement chamber 32 as the tee 100 is driven into the ground.

Figure 7B:
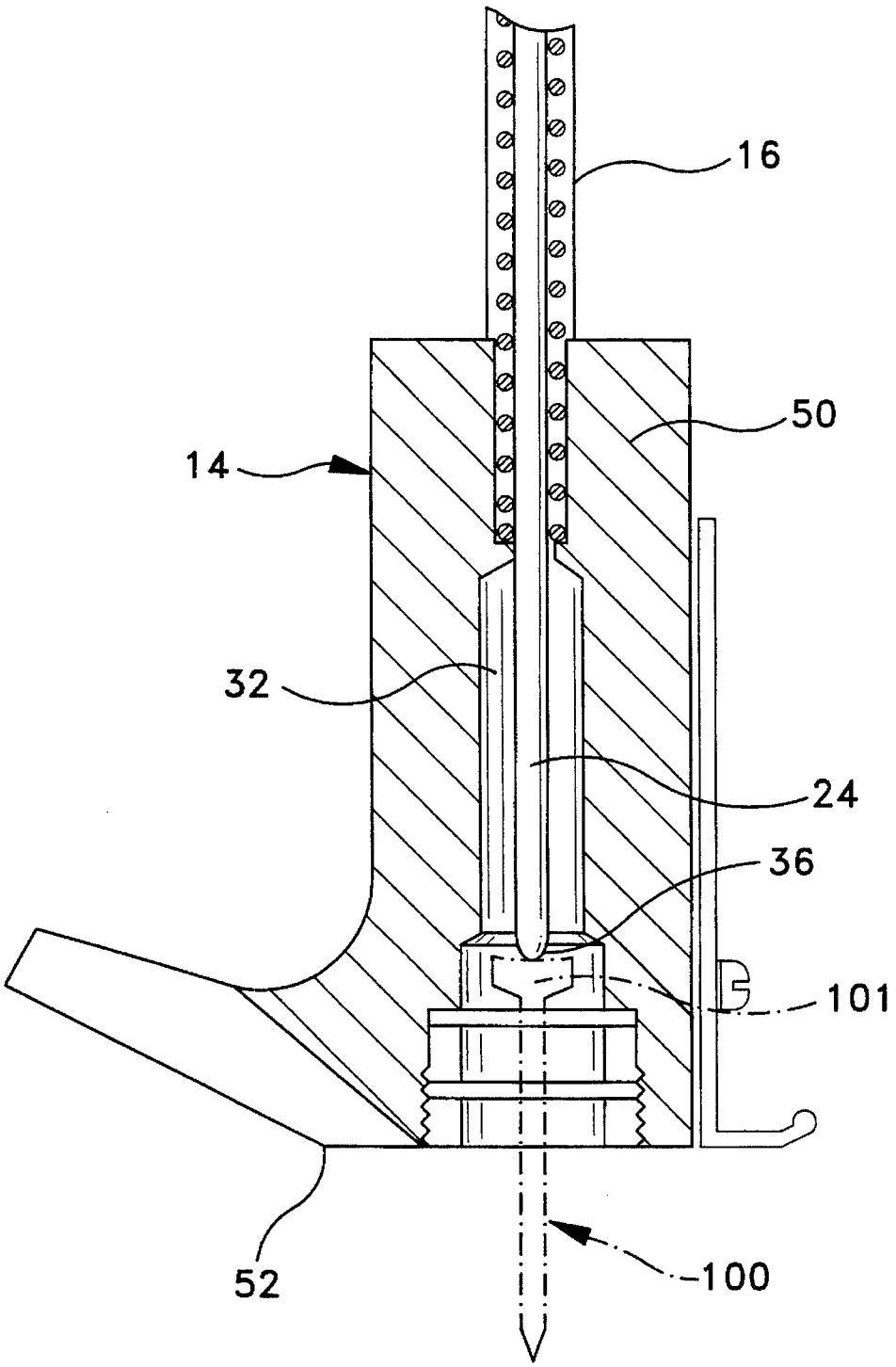
FIG. 7*b* shows a cross-section of the head region of the present invention as it sets a tee into the ground.

In FIG. 6, it can be seen that once the set pin 88 is locked into a selected branch slot 86, the movement of the handle 74 causes the control rod 72 and the pushrod 24 to advance a predetermined distance within the shaft 16 before the primary return spring 90 reaches a point of maximum compression. Referring to FIG. 7*b*, it can be seen that as the pushrod 24 is advanced within the shaft 16, the pointed end 36 of the pushrod 24 advances within the tee engagement chamber 32. The pointed end 36 of the pushrod 24 engages the head 101 of the tee 100 and drives the tee 100 into the ground. Accordingly, if the bottom surface 52 of the J-shaped element 50 is placed on the ground, the pushrod 24 acts to push the tee 100 into the ground. The pushrod 24 will continue to push the tee 100 into the ground until the primary return spring 90 in the handle assembly 12 reaches maximum compression (see FIG. 6). When the handle assembly 12 is set at the ¾ inch setting, as shown in FIG. 6, the pointed end 36 of the pushrod 24 stops at a point ¾ inch from the ground. Consequently, the tee 100 is set at a ¾ inch height. As has been previously explained, the handle can be adjusted between settings of ¼ inch and 2 inches. Accordingly, depending upon how the handle assembly is adjusted, the pushrod 24 will set the tee 100 between heights of ¼ inch and 2 inches.

Figure 7C:
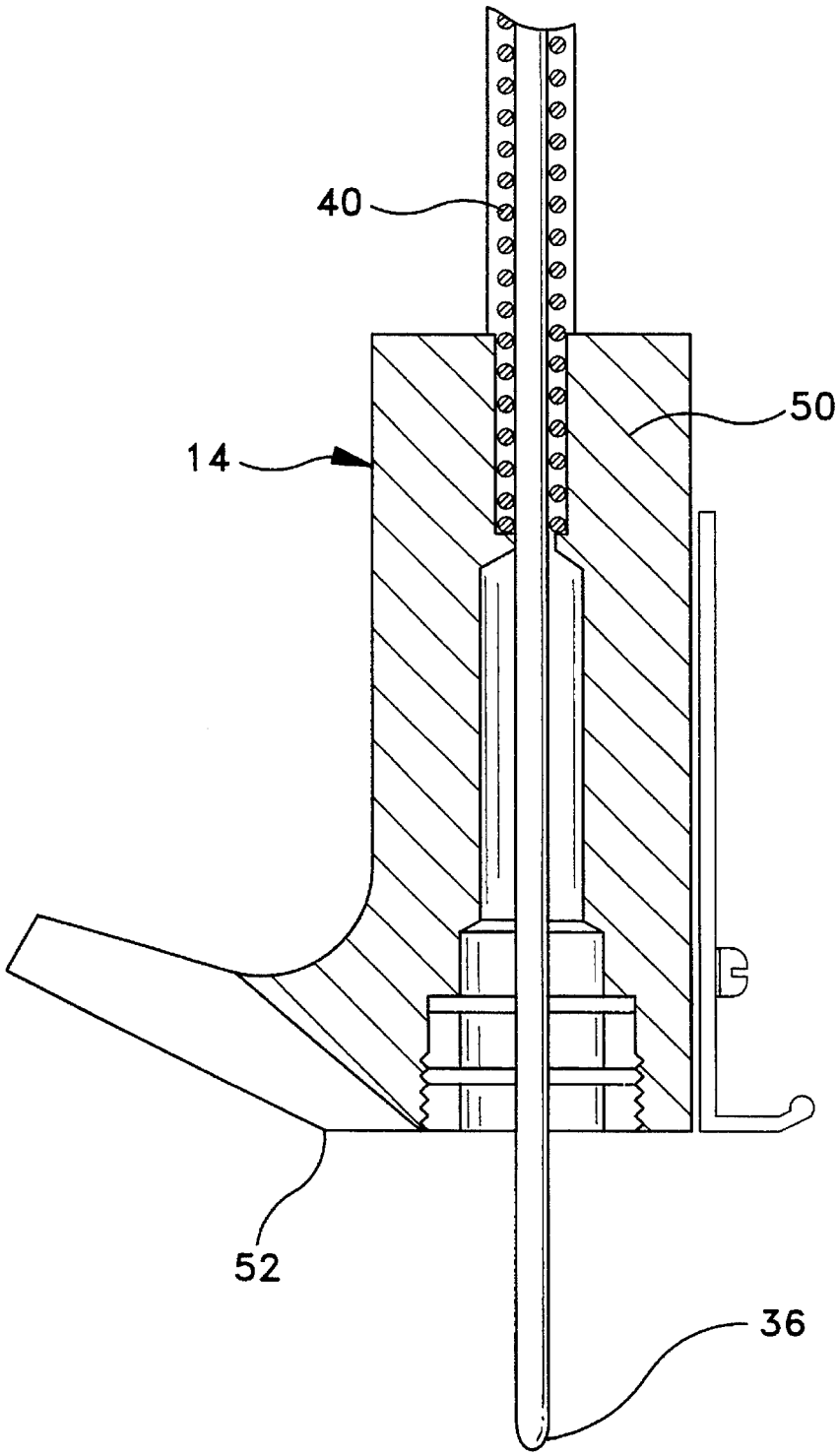
FIG. 7*c* is a cross-section of the head region of the present invention shown making a pilot hole in the ground.

In FIG. 5, the set pin 88 is shown in the primary slot 84 of the slotted structure 82 of the guide tube 80. If the set pin 88 is not turned into one of the branch slots 86,the tee setting device can be used to make a pilot hole in the ground, prior to the setting of a tee. When the set pin 88 is in the primary slot 84, the guide tube 80 does not move with the set pin 88 until the set pin 88 contacts the very bottom of the primary slot 84. At this point, the guide tube 80 finally begins to move and compress the primary return spring 90. Accordingly, the handle 74 advances the pushrod 24 in the shaft 16 a great distance before the handle 74 abuts against the top of the shaft 16 or the primary return spring 90 reaches maximum compression. Referring to FIG. 7*c*, it can be seen that when the handle is not set to a given depth and the pushrod 24 is advanced within the shaft 16, the pointed end 36 of the pushrod 24 extends beyond the bottom surface 52 of the J-shaped element 50. Accordingly, the pointed end 36 of the pushrod 24 can be driven into the ground, thereby creating a pilot hole. The driving of the pointed end 36 into the ground is desirable if the ground is frozen or hard. The creation of the pilot hole enables the tee to be easily set into the ground without breaking the tee. A second alternate use derived from driving the pushrod 24 into the ground is that the pushrod 24 can be used to hold the entire tee setting device in an upright, self-standing position. Once the pushrod 24 is pushed into the ground, the friction from the ground will retain the pushrod 24 in the ground, despite the bias of the secondary return spring 40 trying to pull the pushrod 24 from the ground. As such, the tee setting device can be set into a vertical position on the ground and it will remain in that position, anchored by the pushrod 24 in the ground, until the pushrod 24 is pulled from the ground.

Figure 8:
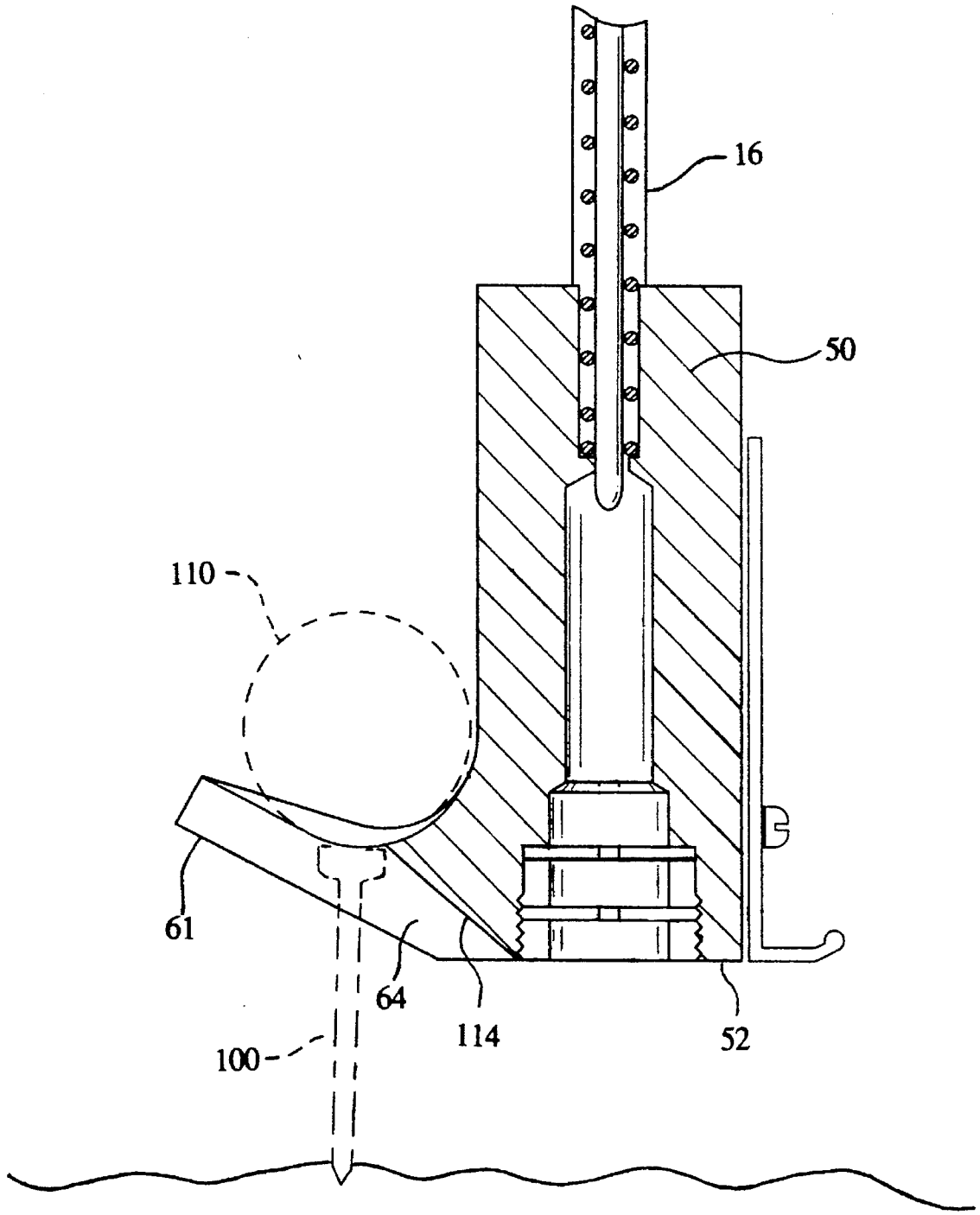
FIG. 8 shows the head region of the present invention in conjunction with a golf ball and tee to illustrate how the present invention is used to set a golf ball upon a tee.

Referring lastly to FIG. 8, it can be seen that a golf ball 110 can be placed within the foot region 61 of the J-shaped element 50. As has previously been described, the foot region 61 has a hammer claw shape that holds a golf ball when the shaft 16 is held vertically. A slot 64 is formed in the center of the J-shaped element 50. The slot 64 is defined by a sloped surface 114 that slopes from the bottom surface 52 to the golf ball 110. As a result, when a tee 100 is placed in the ground and a golf ball 110 is placed in the foot region 61 of the J-shaped element 50, by lowering the J-shaped element 50 onto the tee 100, the slot 64 automatically aligns the tee 100 with the bottom of the golf ball 110. The J-shaped element 50 is then removed, and the golf ball 110 is left resting upon the tee 100.

It will be understood that the various figures described above illustrate only one preferred embodiment of the present invention. A person skilled in the art can therefore make numerous alterations and modifications to the shown embodiment utilizing functionally equivalent components to those shown and described. All such modifications are intended to be included within the scope of the present invention as defined by the appended claims.

What is claimed is:

1. A device for setting a tee, comprising:

retaining means for retaining the tee at an orientation generally perpendicular to the ground;

a tubular shaft having a first end and an opposite second end, wherein said first end is coupled to said retaining means;

a pushrod, disposed within said tubular shaft;

a handle assembly disposed proximate said second end of said tubular shaft in a manner the enables said handle assembly to move independently along said tubular shaft a predetermined distance between a first position and a second position, said handle assembly engaging said pushrod within said tubular shaft and selectively drives said pushrod said predetermined distance through said tubular shaft as said handle assembly travels from said first position to said second position, whereby said pushrod directly contacts the tee held by said retaining means and drives the tee into the ground to a depth related to said predetermined distance traveled by said pushrod; and adjustment means contained within said handle assembly for selectively adjusting said predetermined distance between said first position and said second position, thereby adjusting the depth at which the tee is set into the ground.

2. The device according to claim 1, wherein said adjustment means is adjustable in periodic intervals, thereby enabling the tee to be set at a height of between ¼ inch and 2 inches above the ground by said pushrod.

3. The device according to claim 1, wherein said handle assembly includes;

a hollow handle that surrounds said second end of said tubular shaft;

an elongated member coupled to said hollow handle that extends into said tubular shaft and engages said pushrod, said elongated member having a set pin extending therefrom;

a slotted structure having a plurality of slots disposed thereon between a first end and a second end, said slotted structure surrounding said elongated member in such a manner that said set pin is capable of selectively engaging a targeted slot of said plurality of slots, wherein the position of said slotted structure relative to said elongated member is dependant upon the targeted slot engaged by said set pin.

4. The device according to claim 3, further including a stopping means disposed in said tubular shaft for engaging said first end of said slotted structure when said handle is at said second position, thereby preventing the movement of said pushrod through said tubular shaft beyond said predetermined distance.

5. The device according to claim 1, further including a gauge means for providing a visible indication corresponding to said predetermined distance as determined by said adjustment means.

6. The device according to claim 5, wherein said gauge means includes a plurality of indicia on said hollow shaft, wherein a surface associated with said handle assembly aligns with one of said indicia depending upon the setting associated with said adjustment means.

7. The device according to claim 1, further including a return means for returning said handle assembly from said second position to said first position after the tee has been set by said pushrod.

8. The device according to claim 1 wherein said retaining means is contained within a head assembly disposed at the end of said tubular shaft opposite said handle assembly, said head assembly further including a tee engaging means for engaging and removing a tee previously set into the ground.

9. The device according to claim 8 wherein said head assembly further includes a means for holding a golf ball whereby said device can be utilized to place the golf ball on a tee after the tee is set in the ground.

10. The device according to claim 8, wherein said head assembly further includes a divot repair tool positionable between a retracted position and an extended position.

11. The device according to claim 1, wherein said pushrod has a pointed tip, whereby said pushrod can be driven into the ground by said handle assembly, thereby creating a hole into which the tee can be set.

12. The device according to claim 1, wherein said retaining means includes at least one elastomeric member having an aperture formed therethrough, whereby a tee can be passed through said aperture and said at least one elastomeric member retains the tee in place.

13. A tee setting device, comprising:

a head assembly defining a hollow chamber therein, said hollow chamber communicating with at least one surface positionable upon the ground;

holding means for holding a tee within said hollow chamber;

a shaft coupled to said head assembly;

a pushrod disposed within said shaft;

a handle coupled to said pushrod for driving said pushrod through said shaft within a predetermined range, whereby said pushrod directly contacts the tee held by said holding means and drives the tee out of the head assembly and into the ground to a depth corresponding to a distance traveled by said pushrod; and an adjustable stopping means for selectively stopping the travel of pushrod at a target point among a plurality of points contained within said predetermined range.

14. The device according to claim 13, wherein said predetermined range is at least two inches and said stopping means is adjustable in periodic intervals within said predetermined range.

15. The device according to claim 14, further including a gauge means for providing a visible indication corresponding to said periodic intervals.

16. The device according to claim 13, wherein said pushrod has a pointed tip, whereby said pushrod can be driven into the ground by said handle assembly, thereby creating a hole into which the tee can be set.

17. A method of setting a golf tee, comprising the steps of:

providing an elongated member having a hollow channel formed therethrough and a first open end that communicates with said hollow channel;

providing a pushrod within said hollow channel wherein the pushrod can be advanced in said hollow channel;

selectively limiting the distance the pushrod is permitted to travel within said hollow channel, wherein the distance selected corresponds to a predetermined tee height that a person desires to set the tee on the ground;

positioning a tee within said hollow channel proximate said open end;

placing said open end of said elongated member on the ground;

advancing said pushrod in said elongated member wherein said pushrod engages the tee and drives the tee into the ground to a point where the tee extends above the ground at said predetermined tee height.

18. The method according to claim 17, wherein said predetermined tee height can be selected from between ¼ inch and 2 inches.

19. The method according to claim 17, further including the step of advancing said pushrod beyond said head assembly to create a hole in the earth, prior to positioning the tee within the elongated member, thereby creating a hole into which the tee can be driven.

* * * * *